US010374368B2

(12) United States Patent
Matzen et al.

(10) Patent No.: US 10,374,368 B2
(45) Date of Patent: Aug. 6, 2019

(54) CONNECTOR FOR A COAXIAL CABLE

(71) Applicant: Corning Optical Communications RF LLC, Glendale, AZ (US)

(72) Inventors: Michael Ole Matzen, Vordingborg (DK); Michael Meister, Langebaek (DK); Thomas Dewey Miller, Peoria, AZ (US); Jens Petersen, Vordingborg (DK)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 15/803,147

(22) Filed: Nov. 3, 2017

(65) Prior Publication Data

US 2018/0309246 A1 Oct. 25, 2018

Related U.S. Application Data

(60) Provisional application No. 62/417,669, filed on Nov. 4, 2016.

(51) Int. Cl.
*H01R 9/05* (2006.01)
*H01R 13/58* (2006.01)
(Continued)

(52) U.S. Cl.
CPC ..... *H01R 13/6593* (2013.01); *H01R 9/0524* (2013.01); *H01R 13/5812* (2013.01);
(Continued)

(58) Field of Classification Search
CPC . H01R 43/20; H01R 13/5804; H01R 13/5808
See application file for complete search history.

(56) References Cited

U.S. PATENT DOCUMENTS 4,575,274 A 3/1986 Hayward
4,834,675 A 5/1989 Samchisen
(Continued)

FOREIGN PATENT DOCUMENTS

EP 1758205 A2 2/2007
EP 2393158 A1 7/2011
FR 2462798 A1 2/1981

OTHER PUBLICATIONS

International Search Report and Written Opinion PCT/US2017/059204 dated Jan. 24, 2018.

*Primary Examiner* — Briggitte R. Hammond
(74) *Attorney, Agent, or Firm* — Tamika A. Crawl-Bey

(57) ABSTRACT

A coaxial cable connector for attachment to an end of a coaxial cable is disclosed. The coaxial cable connector has a body having a forward end and a rearward end. An internal surface extends between the forward end and the rearward end defining a longitudinal opening and with a cable receiving area proximal the rearward end and a jacket stop proximal the forward end. A post is positioned in the body proximal the forward end and has a first end and a second end with a bore extending therebetween. An insulator is movably disposed in the bore of the post and has a through-passage and a movement limiter. A gripping member is disposed within the longitudinal opening of the body proximal the rearward end and provides a gripping action as the gripping member axially moves toward the forward end of the body.

14 Claims, 14 Drawing Sheets

(51) Int. Cl.

| | |
|---|---|
| ***H01R 24/56*** | (2011.01) |
| ***H01R 43/20*** | (2006.01) |
| ***H01R 13/6593*** | (2011.01) |
| *H01R 103/00* | (2006.01) |

(52) U.S. Cl.
CPC ..... *H01R 24/56* (2013.01); *H01R 43/20* (2013.01); *H01R 2103/00* (2013.01)

(56) References Cited

U.S. PATENT DOCUMENTS 5,342,218 A * 8/1994 McMills ..... H01R 9/0521 439/374
5,879,191 A 3/1999 Burris
6,089,912 A 7/2000 Tallis et al.
6,817,896 B2 * 11/2004 Derenthal ..... H01R 9/05 439/578
7,288,002 B2 10/2007 Rodrigues et al.
7,297,023 B2 * 11/2007 Chawgo ..... H01R 13/5205 439/578
7,297,029 B2 11/2007 Ueno et al.
7,303,435 B2 12/2007 Burris et al.
7,347,729 B2 * 3/2008 Thomas ..... H01R 4/5033 439/583
7,371,113 B2 5/2008 Burris et al.
7,942,695 B1 * 5/2011 Lu ..... H01R 13/111 439/578
8,075,339 B2 12/2011 Holliday
2004/0031144 A1 2/2004 Holland
2008/0081512 A1 * 4/2008 Chawgo ..... H01R 9/0503 439/578
2008/0166094 A1 7/2008 Bookbinder et al.
2008/0274644 A1 11/2008 Rodriques
2009/0169163 A1 7/2009 Abbott, III et al.
2016/0036138 A1 2/2016 Burris et al.

* cited by examiner

CONNECTOR FOR A COAXIAL CABLE

CROSS-REFERENCE TO RELATED APPLICATION

This application claims the benefit of priority under 35 U.S.C. § 119(e) of U.S. Provisional Application Ser. No. 62/417,669 filed on Nov. 4, 2016, the content of which is relied upon and incorporated herein by reference in its entirety.

FIELD

The disclosure relates generally to coaxial cable connectors, including F-type coaxial cable connectors, for use with coaxial cables that do not require exposing and/or preparing a predetermined length of the outer conductor prior to attaching the coaxial cable to the coaxial cable conductor.

BACKGROUND

Coaxial cable connectors, such as F-connectors, are used to attach coaxial cables to another object such as an appliance or junction having a terminal adapted to engage the connector. For example, F-connectors are often used to terminate a drop cable in a cable television system. The coaxial cable typically includes an inner conductor surrounded by a dielectric layer, which is in turn surrounded by an outer conductor in the form of a conductive grounding foil and/or braid defining an outer conductive grounding sheath. The outer conductive grounding sheath is itself surrounded by a protective outer jacket. The F-connector is typically secured over the prepared end of the jacketed coaxial cable, allowing the end of the coaxial cable to be connected with a terminal block, such as by a threaded connection with a threaded terminal of a terminal block.

In the case of most of the types of connectors, the coaxial cable must be prepared by stripping back the outer jacket to expose the outer conductive grounding sheath and inner conductor, then further requires that the outer conductive grounding sheath be folded back, or everted. The folded back or everted outer conductive grounding sheath facilitates the electrical continuity with the coaxial cable connector when the coaxial cable is installed thereon. In this manner, grounding continuity from the coaxial cable through the coaxial cable connector to the terminal block may be established. Without such effective grounding continuity, spurious signals may compromise the quality or effectiveness of the signals being transmitted by the coaxial cable. However, since the conductive grounding sheath typically is a braided metallic material, the step of flaring and folding the conductive grounding sheath over the outer jacket is a difficult, time consuming and painstaking process. Further, the preparation of the coaxial cable is typically performed manually by an installer using hand tools, and, as such, the results of such preparation may not be consistent between different installers or different coaxial cable connectors. As a non-limiting example, small fragments of the outer braid may break off, affecting the grounding continuity or possibly causing an electrical short in the coaxial cable connector or other nearby electrical systems. Additionally, due to the need to manually perform the coaxial cable preparation, the small fragments may cut and/or enter the skin of the cable installer, resulting in a safety or health concern.

Consequently, there is an unresolved need for a coaxial cable connector that attaches to the coaxial cable without requiring the flaring, folding back or everting of the braided outer conductive grounding sheath of the coaxial cable.

No admission is made that any reference cited herein constitutes prior art. Applicant expressly reserves the right to challenge the accuracy and pertinence of any cited documents.

SUMMARY

One embodiment of the disclosure relates to a coaxial cable connector for attachment to an end of a coaxial cable, the coaxial cable comprising an inner conductor, a dielectric surrounding the inner conductor, an outer conductor surrounding the dielectric, and a jacket surrounding the outer conductor. The coaxial cable connector comprises a body having a forward end and a rearward end, wherein an internal surface extends between the forward end and the rearward end. The internal surface defines a longitudinal opening and the body comprises a cable receiving area proximal the rearward end and a jacket stop proximal the forward end. The coaxial cable connector also comprises a post positioned in the body proximal the forward end of the body, wherein the post comprises a first end and a second end with a bore extending therebetween, and wherein the bore comprises an inner surface and opens toward the rearward end of the body at the second end of the post. The coaxial cable connector also comprises an insulator movably disposed in the bore of the post, wherein the insulator comprises an outer surface in contact with the post, a through-passage, and a movement limiter to limit movement of the insulator in the post. The coaxial cable connector also comprises a gripping member disposed within the longitudinal opening of the body proximal the rearward end of the body, wherein the gripping member is axially movable in the body, and wherein the gripping member provides a gripping action as the gripping member axially moves toward the forward end of the body. The coaxial cable connector also comprises a coupling member attached to the body at the forward end of the body.

Another embodiment of the disclosure relates to a coaxial cable connector for attachment to an end of a coaxial cable. The coaxial cable comprises an inner conductor, a dielectric surrounding the inner conductor, an outer conductor surrounding the dielectric, and a jacket surrounding the outer conductor. The coaxial cable connector comprises a body having a forward end and a rearward end, and an internal surface extending between the forward end and the rearward end. The internal surface defines a longitudinal opening and the body comprises a cable receiving area proximal the rearward end and a jacket stop proximal the forward end. The jacket stop is configured to contact an end of the jacket of the coaxial cable received by the body through the cable receiving area and block forward movement of the coaxial cable. The coaxial cable connector also comprises a post positioned in the body proximal the forward end of the body. The post comprises a first end and a second end with a bore extending therebetween and the bore comprises an inner surface and opens toward the rearward end of the body at the second end of the post. The first end of the post comprises a forward face, and the second end of the post is configured to insert under the jacket to electrically contact the outer conductor of the coaxial cable received by the body. The coaxial cable connector also comprises an insulator movably disposed in the bore of the post. The insulator comprises a forward side, a rearward side, and an outer surface in contact with the post, a through-passage extending from the forward side through the rearward side and adapted to receive and guide an inner conductor of a coaxial cable, and a movement limiter to limit movement of the insulator in the post at the first end of the post. The coaxial cable connector also comprises a gripping member disposed within the longitudinal opening of the body proximal the rearward end of the body, wherein the gripping member is axially movable toward the forward end of the body, and wherein the gripping member provides a gripping action as the gripping member axially moves toward the forward end of the body, wherein the gripping action is configured to cause the gripping member to engage the jacket of the coaxial cable received by the body to secure the coaxial cable in the body. The coaxial cable connector also comprises a coupling member attached to the body at the forward end.

Yet another embodiment of the disclosure relates to a method for connecting a coaxial cable to a coaxial cable connector, the coaxial cable comprising an inner conductor, a dielectric surrounding the inner conductor, an outer conductor surrounding the dielectric, and a jacket surrounding the outer conductor. The method comprises preparing a coaxial cable by exposing a predetermined length of the inner conductor beyond the ends of the jacket, the dielectric, and the outer conductor, wherein the ends of the jacket, the dielectric, and the outer conductor remain generally flush with each other. The method further comprises inserting the prepared coaxial cable into a cable receiving area of a body of a coaxial cable connector, wherein the body has a forward end and a rearward end, and an internal surface extending between the forward end and the rearward end, the internal surface defining a longitudinal opening, and wherein the cable receiving area is proximal the rearward end. The method further comprises advancing the prepared coaxial cable toward the forward end of the body of the coaxial cable connector until the end of the jacket contacts a jacket stop proximal the forward end of the body, wherein the inner conductor is received by and guided through a through-passage in an insulator movably positioned in a post disposed proximal the forward end of the body, and wherein an end of the dielectric contacts a rearward side of the insulator, and wherein a forward side of the insulator is flush with a forward face of the post. The method further comprises axially moving a gripping member disposed within the longitudinal opening of the body proximal the rearward end of the body toward the forward end of the body to cause a gripping action of the gripping member to engage the jacket of the coaxial cable received by the body to secure the coaxial cable in the body.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiments, and together with the description serve to explain principles and operation of the various embodiments.

DETAILED DESCRIPTION

Figure 1A:
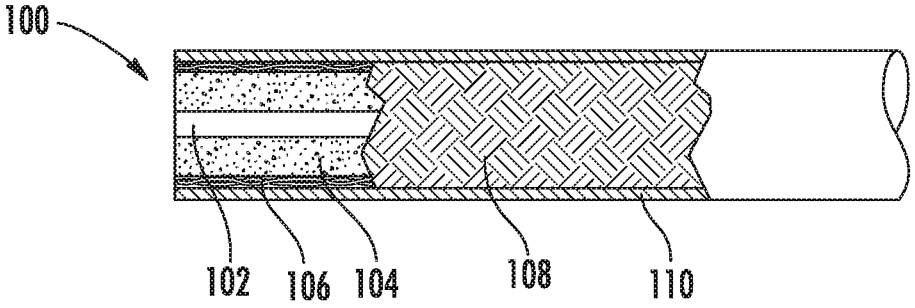
FIG. 1A is a partial cross-sectional view of a coaxial cable useful for description of the various cable constituents.

Reference will now be made in detail to the present preferred embodiments, examples of which is/are illustrated in the accompanying drawings. Whenever possible, the same reference numerals will be used throughout the drawings to refer to the same or like parts.

Figure 1B:
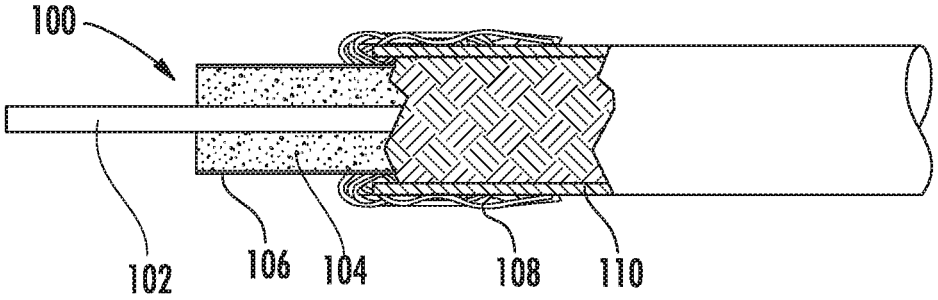
FIG. 1B is a partial cross-sectional view of a coaxial cable prepared using conventional preparation methods.

Referring to FIGS. 1A and 1B, a conventional coaxial cable 100 is illustrated as well as the method in which the end of the coaxial cable 100 is prepared. Referring to FIG. 1A, the coaxial cable 100 has an inner conductor 102 that is surrounded by a dielectric layer 104. The dielectric layer (or dielectric) 104 may also have a foil or other metallic covering 106. Coaxial cable 100 then has a braided outer conductor 108 which is covered and protected by a jacket 110. Typically, to prepare the coaxial cable 100 for attachment to a coaxial cable connector, a portion of the inner conductor 102 is exposed as illustrated in FIG. 1B. The jacket 110 is trimmed back so that a portion of the dielectric 104 (and metallic covering 106 if present) and braided outer conductor 108 are exposed. The braided outer conductor 108 is then folded back, or everted, over the jacket 110, exposing the dielectric 104 and the metallic covering 106.

Figure 1C:
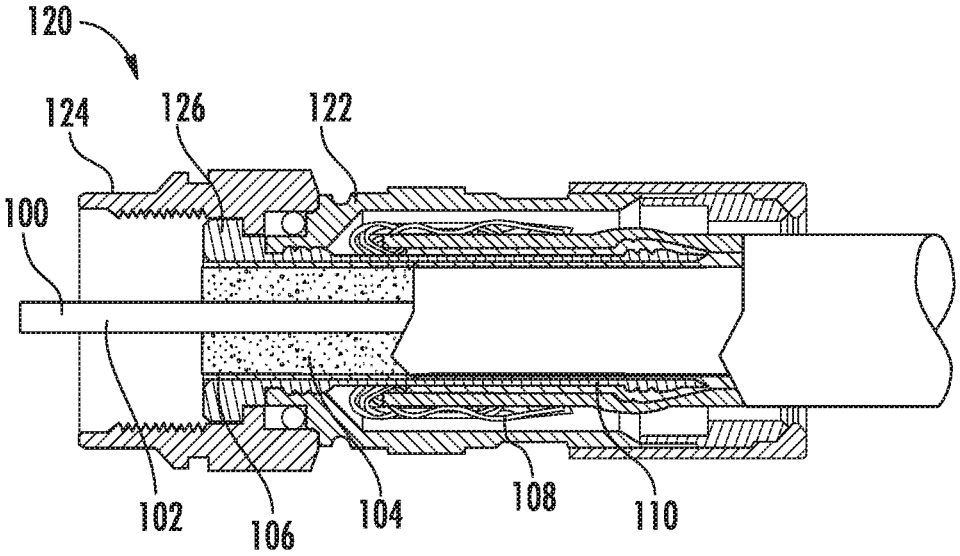
FIG. 1C is a cross-sectional view of a conventional coaxial connector utilizing a post with a coaxial cable installed.

FIG. 1C illustrates a conventional coaxial cable connector 120 attached to the prepared coaxial cable 100 of FIG. 1B. The coaxial cable connector 120 has a body portion 122 and a coupling member 124 beyond which the inner conductor 102 extends. Inside the body portion 122 is a post 126. The post 126 is used to secure the coaxial cable 100 to the coaxial cable connector 120 and to establish grounding continuity between the braided outer conductor 108 and the coaxial cable connector 120. As can be seen in FIG. 1C, the post 126 is inserted into the coaxial cable 100 under the jacket 110 between the braided outer conductor 108 and the dielectric 104 and the metallic covering 106. As the post 126 is inserted under the jacket 110, the post 126 physically contacts the braided outer conductor 108, while an exposed length of the dielectric 104 and the metallic covering 106 extends into the post 126 beyond the end of the jacket 110. In this manner, the post 126 is in continuity with the braided outer conductor 108 and the metallic covering 106. Moreover, since the braided outer conductor 108 is folded back over the jacket 110, the body portion 122 also comes in contact with the braided outer conductor 108, resulting in the post 126 and the body portion 122 having electrical continuity with the coaxial cable 100 through the braided outer conductor 108 and/or the metallic covering 106. Since the coupling member 124 may be connected to one or both of the post 126 and the body portion 122, electrical continuity, and thereby grounding continuity, may be extended from the coaxial cable 100 through the coaxial cable connector 120 and to a terminal to which the coupling member 124 may couple.

When discussing coaxial connectors herein, unless otherwise specifically indicated by the text or context of the description, reference to "forward" or "front" shall be understood to mean or indicate toward the end of the coaxial cable connector that couples to a terminal, while reference to "rearward" or "rear" shall be understood to mean or indicate the end of the coaxial cable connector that receives a coaxial cable. In this regard, and as can be seen in FIG. 1C, the post 126 may extend from the coupling member 124 at a forward end of the coaxial cable connector 120 through the body portion 122 and, almost, right up to the rearward end of the coaxial connector 120 where the coaxial cable 100 is received by the coaxial cable connector 124. With this conventional coaxial cable connector 120, a substantial length of a rear portion of the post 126 must be inserted under the jacket 110 to adequately secure and stabilize the cable prior to, during, and after closing the coaxial cable connector 120 by compressing the coaxial cable connector 120 with a compression tool. However, sufficient length of the braided outer conductor 108 may have to be exposed and folded back rearwardly to establish and maintain grounding continuity as the post 126 is inserted under the jacket 110 to also assure that grounding continuity is established and maintained during and after attaching the coaxial cable connector 120 to the coaxial cable 100. Additionally, sufficient length of the dielectric 104 has to be exposed beyond the jacket 110 so that the dielectric 104 can insert into the post 126 to the forward end of the post 126 to insulate and separate the inner conductor 102 from the post 126 and prevent grounding the signal transmitted in the inner conductor 102.

Figure 2:
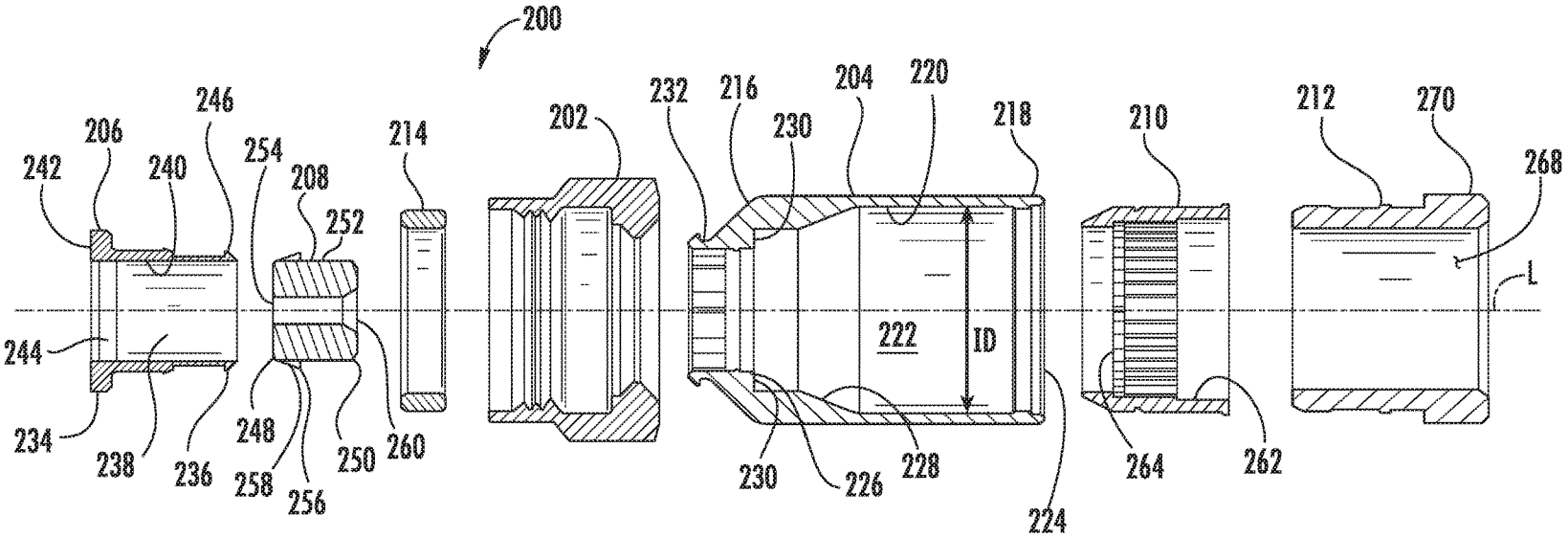
FIG. 2 is an exploded cross-sectional view of an exemplary embodiment of a coaxial cable connector for use with a coaxial cable prepared using an exemplary method of preparation.
Figure 3:
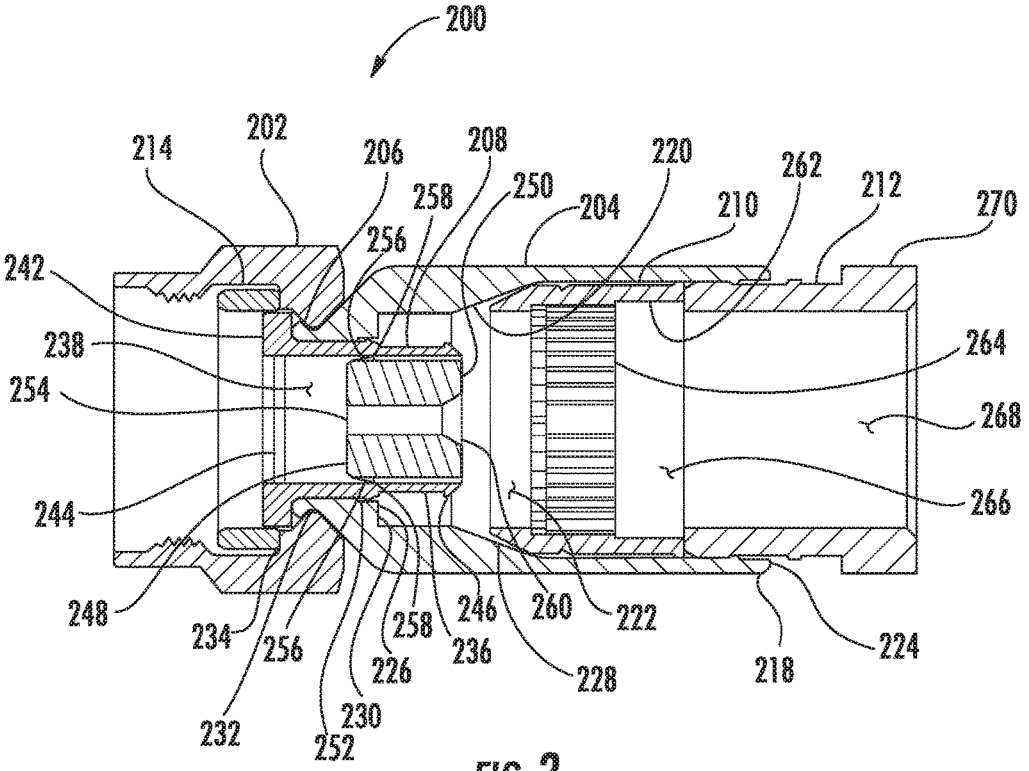
FIG. 3 is a cross-sectional view of the coaxial cable connector of FIG. 2 in an assembled state and an open condition without a coaxial cable inserted therein.

Referring now to FIGS. 2 and 3, exploded and assembled cross-sections, respectively, of an exemplary coaxial cable connector 200 are shown without a coaxial cable installed therein and with the coaxial cable connector 200 illustrated in an open condition in FIG. 3. The coaxial cable connector 200 may include a coupling member 202, a body 204, a post 206, an insulator 208, a gripping member 210, a ring 212 and a gasket 214. Although in FIG. 2, all of the above mentioned components are shown as being centrally aligned on a common longitudinal axis "L", such an alignment for the components is not necessary. As illustrated in FIG. 2, the body 204 has a forward end 216 and a rearward end 218. An internal surface 220 extends between the forward end 216 and the rearward end 218, with the internal surface 220 defining a longitudinal opening 222. A cable receiving area 224 is proximal the rearward end 218 and a jacket stop 226 is proximal the forward end 216. The longitudinal opening 222 has a transverse internal dimension "ID," which may align, generally, orthogonally with the longitudinal axis "L." Additionally, the internal surface 220 may include an angled surface 228 so that the internal dimension "ID" of the longitudinal opening 222 lessens toward the forward end 216 at a portion of the longitudinal opening 222 along the internal surface 220. In other words, the longitudinal opening 222 may be narrower toward the forward end 216 of the body 204.

The jacket stop 226 may be in the form of a rearward facing surface 230 extending radially inwardly from the internal surface 220 of the body 204. As will be discussed below, the jacket stop 226 may be configured to contact an end of the jacket of the coaxial cable received by the body 204 through the cable receiving area 224 and, thereby, block forward movement of the coaxial cable. In addition to the jacket stop 226, the forward end 216 of the body 204 may have a neck area 232, with the rearward facing surface 230, discussed above with respect to the jacket stop 226, forming a rear surface of the neck area 232. The neck area 232 may be used to position the post 206 in the body 204. In this regard, the post 206 may position in the body 204 proximal the forward end 216 of the body 204 by being friction fit to the body 204 at the neck area 232. The body 204 may be constructed from any suitable material, including a thermoplastic polymer (polyoxymethylene), such as Acetal, as a non-limiting example.

The coupling member 202 may be a nut or any other suitable device for coupling the coaxial cable connector 200 to a terminal. In FIGS. 2 and 3, the coupling member 202 is depicted as a coupling nut rotatably attached to the body 204 at the neck area 232. The coupling member 202 may be constructed from any suitable material, including a metallic material, for example brass, and plated with a corrosion resistant material, such as nickel. The gasket 214 may position in the coupling member 202 proximal the post 206 and provide environmental protection to the coaxial cable connector 200 when the coupling member 210 is attached to a terminal. The gasket 214 may be made from any suitable material, including a resilient polymer material such as ethylene propylene diene monomer (EPDM), as a non-limiting example.

Figure 4:
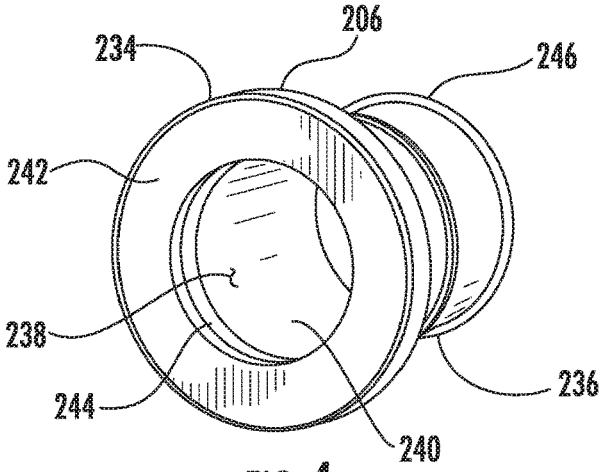
FIG. 4 is a front perspective, detail view of the post of the coaxial cable connector of FIGS. 2 and 3.

Referring now also to FIG. 4, the post 206 may have a first end 234 and a second end 236 with a bore 238 extending therebetween; the bore 238 having an inner surface 240. The first end 234 of the post 206 may include a forward face 242 with the bore 238 of the post 206 opening toward the forward end 216 of the body 204 at the first end 234 at the forward face 242. The post 206, at the first end 234, may include a groove 244 in the inner surface 240 of the bore 238. Additionally, the bore 238 of the post 206 may open toward the rearward end 218 of the body 204 at the second end 236. At the second end 236, the post 206 may include a barb 246 extending radially outwardly from the post 206. The second end 236 of the post 206 may be configured to insert under the jacket to electrically contact the outer conductor of the coaxial cable received by the body 204 as installed in the coaxial cable connector 200. This will be discussed in more detail below. The post 206 may be constructed so that the insulator 208 may be movably disposed in the bore 238 of the post 206. The post 206 may be constructed from any suitable material, including a metallic material, such as brass, as a non-limiting example, and plated with a corrosion resistant material, such as tin.

Figure 5:
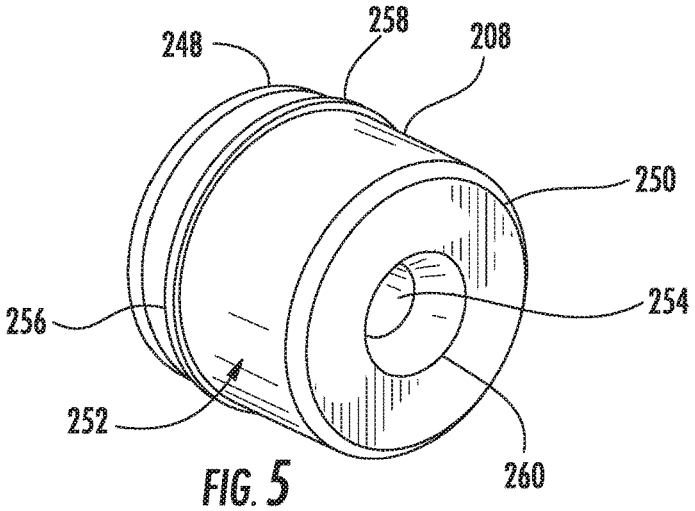
FIG. 5 is a rear perspective, detail view of the insulator of the coaxial cable connector of FIGS. 2 and 3.

Referring now also to FIG. 5, the insulator 208 may have a forward side 248 and a rearward side 250, and an outer surface 252 in contact with the post 206, a through-passage 254, and a movement limiter 256 to limit movement of the insulator 208 in the post 206. As shown in FIG. 3, the insulator 208 may slip fit into the bore 238 of the post 206 so that the outer surface 252 of the insulator 208 may adjoin the inner surface 240 of the bore 238 of the post 206 in such a manner as to allow movement of the insulator 208 in the bore 238, subject to the movement limiter 256. The movement limiter 256 may be in the form of at least one projection 258 extending radially outwardly from the outer surface 252 of the insulator 208. In the case where the post 206 has a groove 244 in the inner surface 240 of the bore 238, the at least one projection 258 may locate in the groove 244 to limit movement of the insulator 208. The movement limiter 256 may limit movement of the insulator 208 at the first end 234 of the post 206 to where the forward side 248 of the insulator 208 is flush with the forward face 242 of the post 206. The through-passage 254 opens at the forward side 248 and the rearward side 250. The through-passage 254 opens at the rearward side 250 in an angled or funnel-shaped rear opening 260. The through-passage 254 may be adapted to receive and guide an inner conductor of a coaxial cable at the rear opening 260. The insulator 208 may be constructed from any suitable material, including a thermoplastic polymer (polyoxymethylene), such as Acetal, as a non-limiting example.

Figure 6:
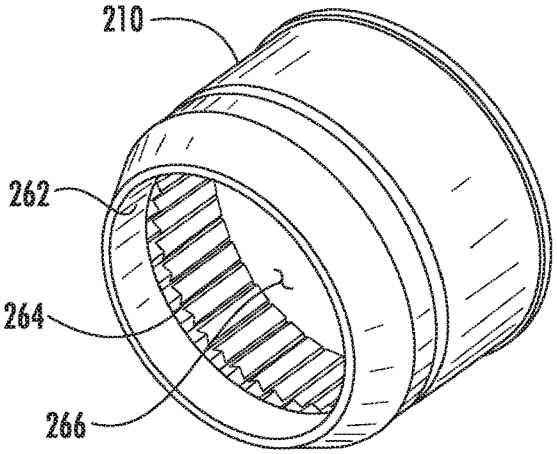
FIG. 6 is a front perspective, detail view of the gripping member of the coaxial cable connector of FIGS. 2 and 3.

The gripping member 210 may be disposed within the longitudinal opening 222 of the body 204 proximal the rearward end 218 of the body 204. The gripping member 210 is axially movable in the body 204, so that the gripping member 210 may provide a gripping action as the gripping member 210 axially moves toward the forward end 216 of the body 204. Referring now also to FIG. 6, the gripping member 210 has an internal surface 262, and at least a portion of the internal surface 262 may have projections 264 extending radially inwardly. Alternatively, although not shown in FIGS. 2, 3 and 6, the gripping member 210 may include at least one flexible finger extending longitudinally from the gripping member 210. The gripping action is configured to cause the gripping member 210 to engage the jacket of the coaxial cable received by the body 204 to secure the coaxial cable in the body 204, and, thereby, to the coaxial cable connector 200.

As the gripping member 210 axially moves toward the forward end 216 of the body 204, the internal surface 220 forces the gripping member 210 radially inwardly as the longitudinal opening 222 narrows to provide the gripping action and causes the gripping member 210 to engage the jacket of the coaxial cable received by the body 204. The gripping member 210 may engage the jacket at about a location aligned with the second end 236 of the post 206. The ring 212 at least partially movably disposed in the cable receiving area 224 of the rearward end 218 of the body 204 may be used to push the gripping member 210 to radially move the gripping member 210 toward the forward end 216 of the body 204. In such case, the coaxial cable may be received by the coaxial cable connector 200 at the cable receiving area 224 of the body 204, inserted through a ring opening 268 (not shown) in the ring 212 and into a cable passage 266 of the gripping member 210. A compression tool (not shown) may be used to move the ring 212 and, thereby, axially move the gripping member 210, by engaging the base of the compression tool with the ring 212 at a rear shoulder 270 (not shown) of the ring 212. The rear shoulder 270 may radially extend beyond the internal surface 220 of the body 204, so that the compression tool stops moving the ring 212 when the rear shoulder 270 contacts the rearward end 218 of the body 204. The gripping member 210 may be constructed from any suitable material, including a metallic material, such as brass, as non-limiting example, and may be plated with a conductive corrosion resistant material, such as nickel. Alternatively, the gripping member 210 may be constructed of a high-strength polymer, such as amorphous thermoplastic polyethermide (Ultem), Nylon, or the like, as non-limiting examples. The ring 212 may be constructed from any suitable material, including a thermoplastic polymer (polyoxymethylene), such as Acetal, as a non-limiting example.

Figure 7:
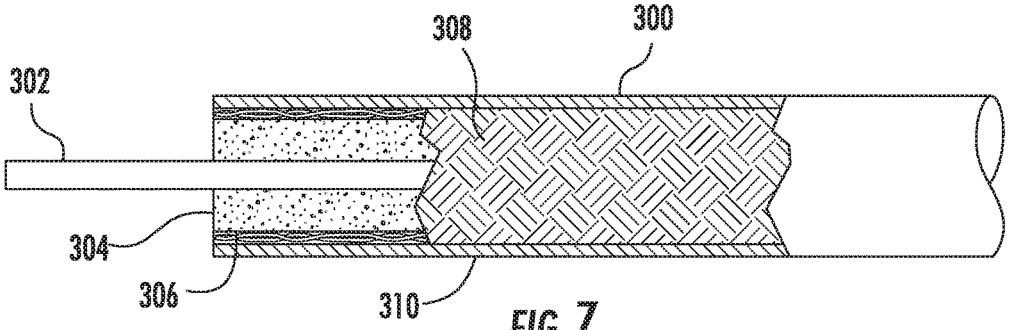
FIG. 7 is a partial cross-sectional view of a prepared coaxial cable using an exemplary method of preparation.

FIG. 7 illustrates a coaxial cable 300 in a prepared state for use with the coaxial cable connector 200. The coaxial cable 300 is substantially like the coaxial cable 100 noted above, except that cable end is prepared differently. While the inner conductor 302 is still exposed, the jacket 310 is not trimmed back so that a portion of the dielectric 304 (and metallic covering 306 if present) and braided outer conductor 308 are exposed. In other words, the ends of the jacket 310, dielectric 304, metallic covering 306 and braided outer conductor 308 are cut and remain generally flush with each other. In FIG. 7, a portion of the jacket 310 and the braided outer conductor 308, for graphical representation purposes only, are shown cut back, to illustrate the manner in which the ends of the jacket 310, dielectric 304, metallic covering 306, and braided outer conductor 308 are cut flush with each other. Additionally, the braided outer conductor 308 does not have to be folded back, or everted, over the jacket 310, exposing the dielectric 304 and the metallic covering 306. Accordingly, preparing coaxial cable 300 is much simpler, requiring less time and avoiding possible safety and health concerns and resultant signal transmission problems. Additionally, since only the inner conductor 302 is being exposed during the preparation, the preparation of coaxial cable 300 may be more consistently achieved than the prepared coaxial cable 100.

Figure 8:
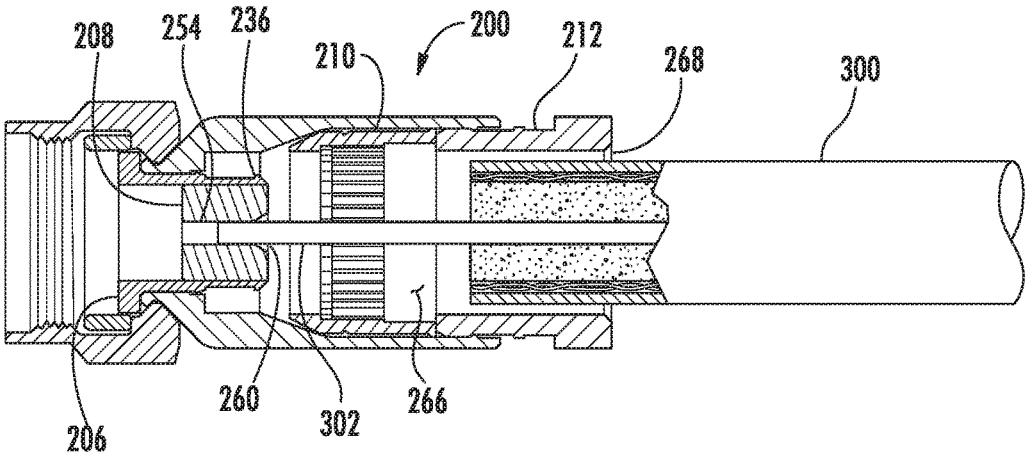
FIG. 8 is a cross-sectional view of the coaxial cable connector of FIG. 3 in an open condition with the coaxial cable of FIG. 7 partially installed therein.

Turning to FIG. 8, the coaxial cable connector 200 is shown in the open condition with the coaxial cable 300 partially installed. The coaxial cable 300 is shown inserted through the ring opening 268 in the ring 212 with the inner conductor 302 extending through the cable passage 266 of the gripping member 210 and into the rear opening 260 of the through-passage 254 of the insulator 208. As noted above, the rear opening 260 of the through-passage 254 is angled to facilitate receiving and guiding the inner conductor 302 into the through-passage 254. Additionally, in FIG. 8, the insulator 208 is positioned toward the second end 236 of the post 206 to further facilitate the guiding and receiving of the inner conductor 302.

Figure 9:
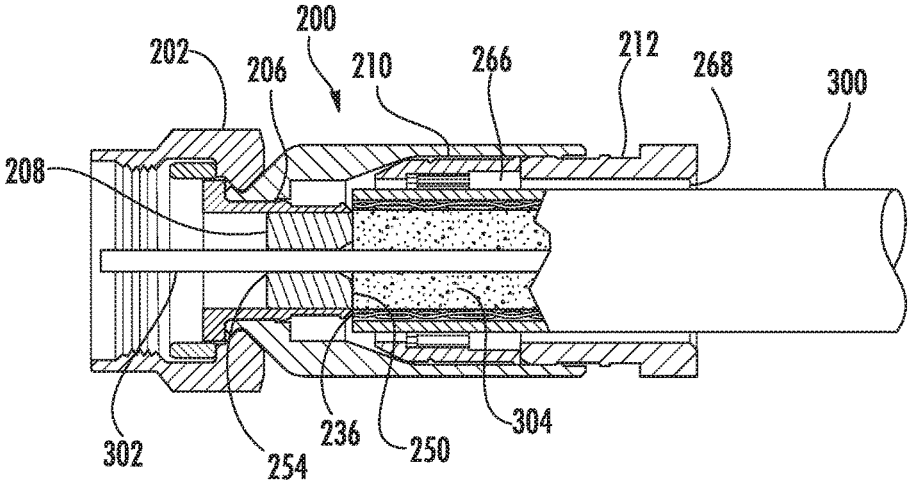
FIG. 9 is a cross-sectional view of the coaxial cable connector of FIG. 3 in an open condition with the coaxial cable of FIG. 7 partially installed therein, although further inserted than as illustrated in FIG. 8.

In FIG. 9, the coaxial cable connector 200 is still shown in the open condition and with the coaxial cable 300 partially installed, but further than shown in FIG. 8. In FIG. 9, the coaxial cable 300 is shown inserted through the ring opening 268 in the ring 212 and through the cable passage 266 of the gripping member 210. The inner conductor 302 is further guided through the through-passage 254 of the insulator 208 and extends into the coupling member 202. Also, the end of the dielectric 304 has contacted the rearward side 250 of the insulator 208 at the second end 236 of the post 206.

Figure 10:
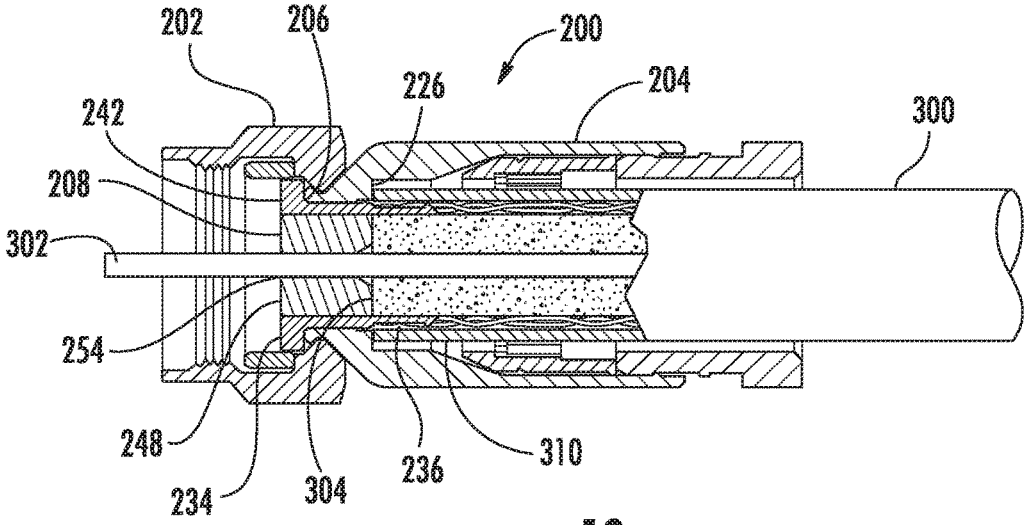
FIG. 10 is a cross-sectional view of the coaxial cable connector of FIG. 3 in an open condition with the coaxial cable of FIG. 7 inserted therein.

In FIG. 10, the coaxial cable connector 200 remains in the open condition, but the coaxial cable 300 extends to the jacket stop 226 of the body 204. The jacket stop 226 has blocked the coaxial cable 300 from being inserted in the coaxial cable connector 200 any further. Additionally, the inner conductor 302 continues through the through-passage 254 of the insulator 208 so that the inner conductor 302 extends beyond, i.e., more forward of, the coupling member 202. Further, as the coaxial cable 300 continues to insert into the coaxial cable connector 200, the end of the dielectric 304 forces the insulator 208 to move forwardly in the post 206 to where the forward side 248 of the insulator 208 is flush with the forward face 242 of the post 206 at the first end 234 of the post 206, while the second end 236 of the post 206 was forced under the jacket 310.

Figure 11:
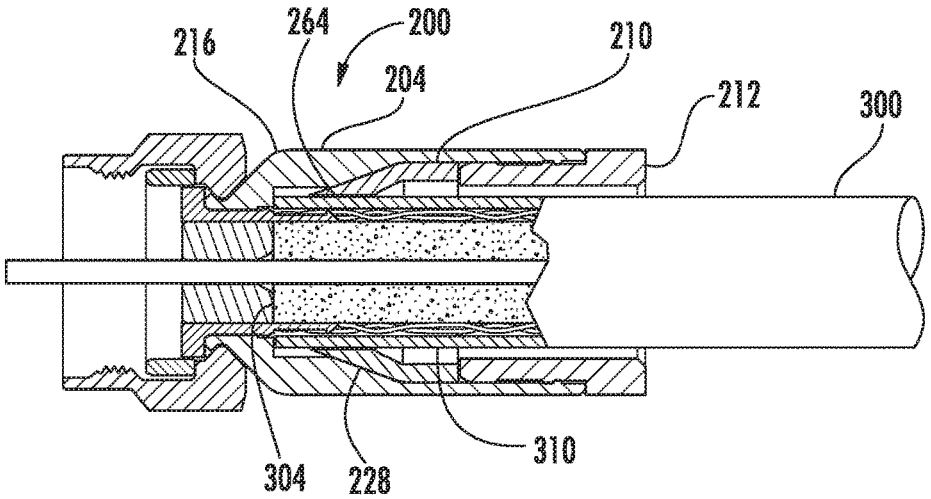
FIG. 11 is a cross-sectional view of the coaxial cable connector of FIG. 3 in a closed condition with the coaxial cable of FIG. 7 inserted therein.

FIG. 11 illustrates the coaxial cable connector 200 with the coaxial cable 300 fully inserted and with the coaxial cable connector 200 in the closed condition. In the closed condition, a compression tool (not shown) has been used to move the ring 212 and, thereby, axially move the gripping member 210 toward the forward end 216 of the body 204. As the gripping member 210 contacts the angled surface 228 of the body 204, projections 264 extending radially inwardly from the internal surface 262 of the gripping member 210 are forced inwardly. In this manner, the projections 264 engage the jacket 310 of the coaxial cable 300 to provide the gripping action of the gripping member 210.

Figure 12:
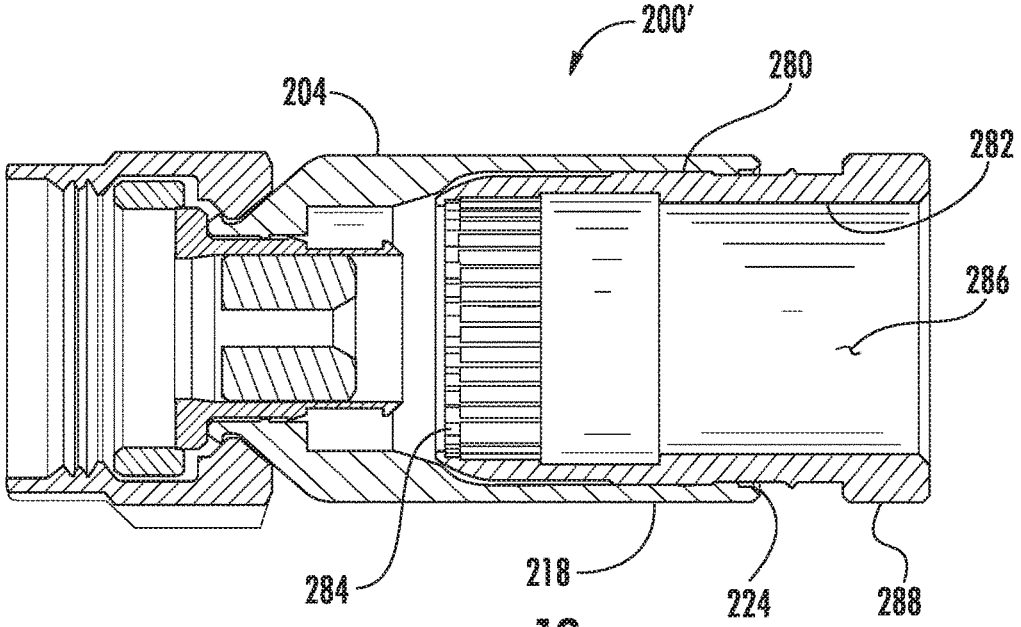
FIG. 12 is a cross-sectional view of another exemplary coaxial cable connector in an assembled state and an open condition without a coaxial cable inserted therein.
Figure 13:
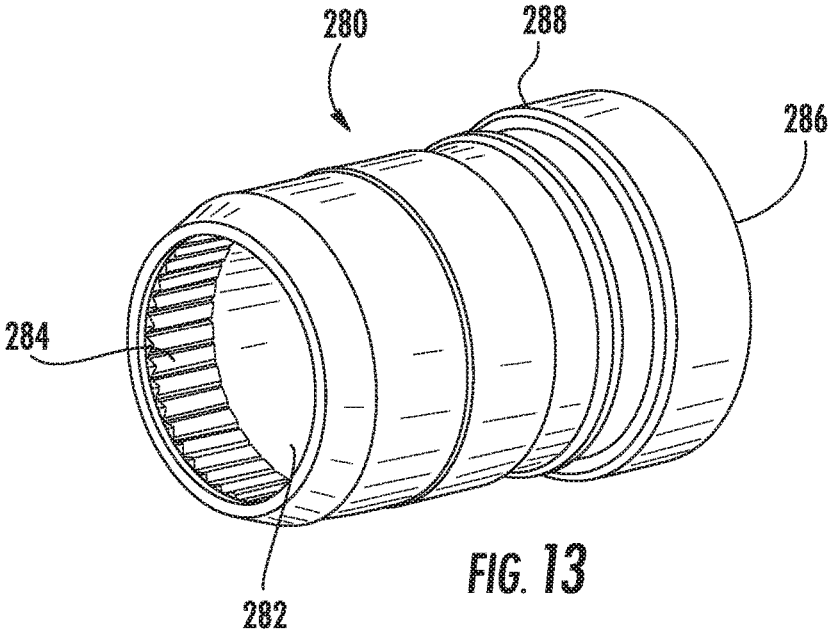
FIG. 13 is a front perspective, detail view of a gripping member of the coaxial cable connector of FIG. 12.
Figure 14:
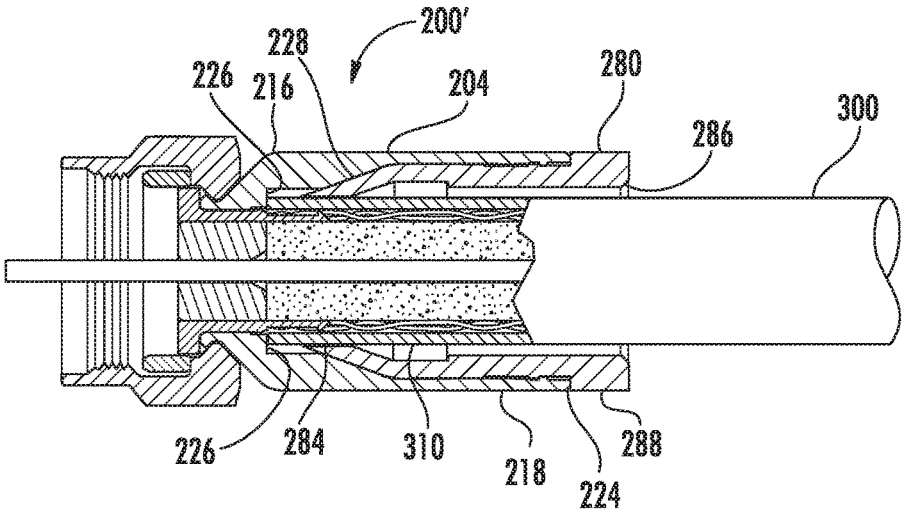
FIG. 14 is a cross-sectional view of the coaxial cable connector of FIG. 12 in a closed condition with the coaxial cable of FIG. 7 inserted therein.

Referring now to FIGS. 12-14, there is depicted an exemplary embodiment of a coaxial cable connector 200'. The coaxial cable connector 200' is similar to the coaxial cable connector 200, except with respect to gripping member 280. Therefore, except as necessary to describe the gripping member 280, the discussion of the aspects of the coaxial cable connector 200' that are similar to the coaxial cable connector 200 will not be restated here with respect to FIGS. 12-14.

FIG. 12 illustrates the coaxial cable connector 200' in an open condition without a coaxial cable installed therein, and FIG. 13 provides a detail view of the gripping member 280. The gripping member 280 combines the gripping member and ring in one component. Accordingly, gripping member 280 has an internal surface 282, projections 284, cable passage 286, and rear shoulder 288. FIG. 14 illustrates the coaxial cable connector 200' with the coaxial cable 300 fully inserted and with the coaxial cable connector 200' in the closed condition. The coaxial cable 300 extends to the jacket stop 226 of the body 204 in a similar fashion as discussed for the coaxial cable connector 200 with reference to FIG. 11. However, in FIG. 14, a compression tool (not shown) has been used to axially move the gripping member 280 toward the forward end 216 of the body 204. As the gripping member 280 contacts the angled surface 228 of the body 204, projections 284 extending radially inwardly from the internal surface 282 of the gripping member 280 are forced inwardly. In this manner, the projections 284 engage the jacket 310 of the coaxial cable 300 to provide the gripping action of the gripping member 280.

Figure 15:
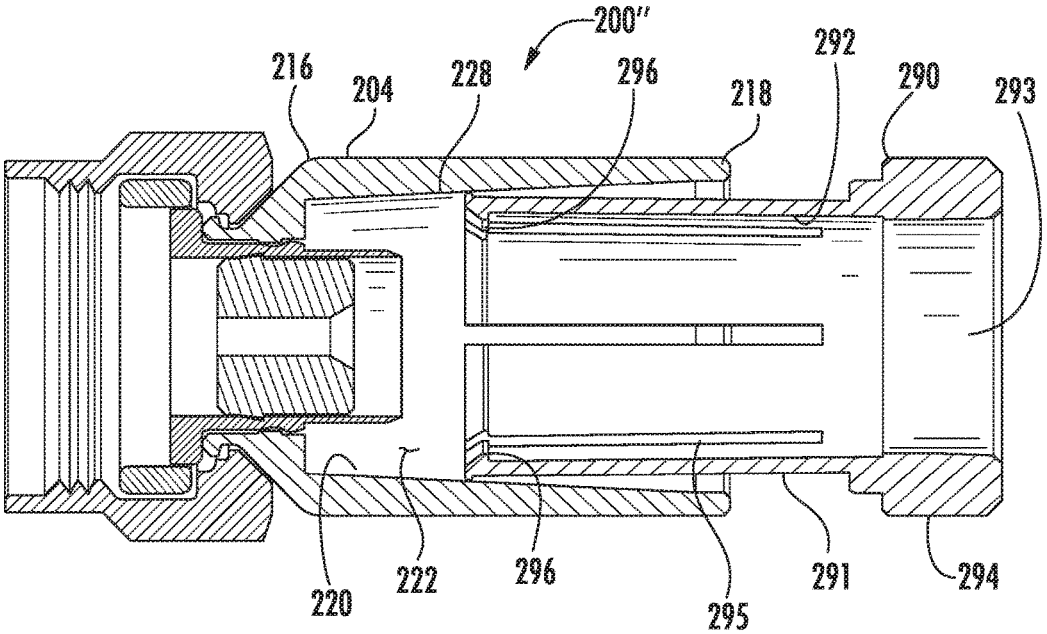
FIG. 15 is a cross-sectional view of another exemplary coaxial cable connector in an assembled state and an open condition without a coaxial cable inserted therein.
Figure 16:
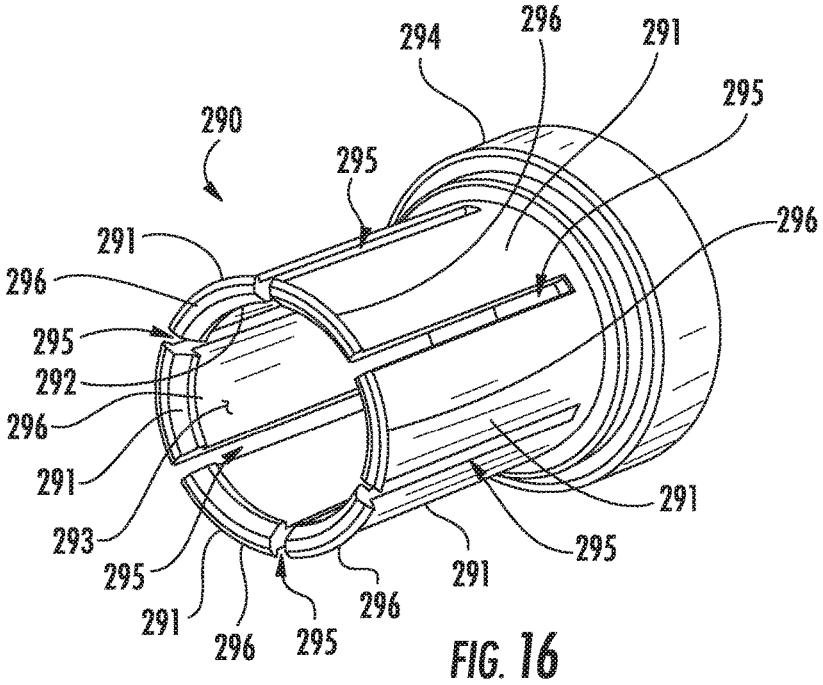
FIG. 16 is a front perspective, detail view of a gripping member of the coaxial cable connector of FIG. 15.
Figure 17:
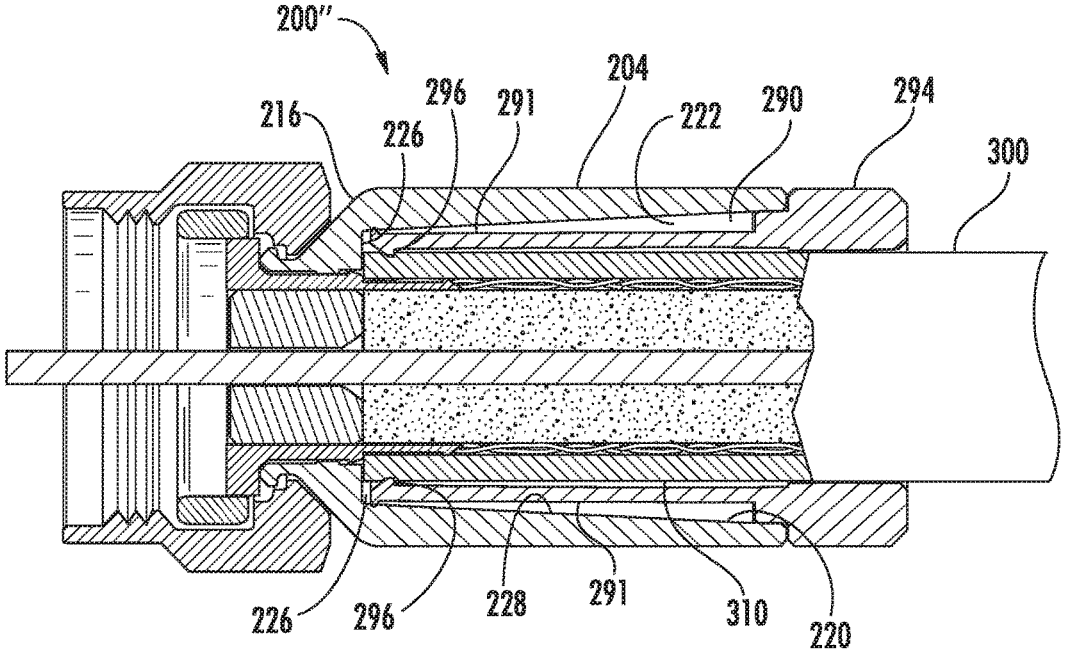
FIG. 17 is a cross-sectional view of the coaxial cable connector of FIG. 15 in a closed condition with the coaxial cable of FIG. 7 inserted therein.

Turning now to FIGS. 15-17, there is depicted another exemplary embodiment of a coaxial cable connector 200". The coaxial cable connector 200" is similar to the coaxial cable connector 200, except that gripping member 290 has at least one flexible finger 291. Additionally, the angled surface 228 of the body 204 may extend over a larger portion of the longitudinal opening 222 along the internal surface 220 than as discussed with respect to coaxial cable connectors 200, 200'. Therefore, except as necessary to describe the gripping member 290 and the gripping action provided thereby, the discussion of the aspects of the coaxial cable connector 200" that are similar to the coaxial cable connectors 200, 200' will not be restated here with respect to FIGS. 15-17.

FIG. 15 illustrates the coaxial cable connector 200" in an open condition without a coaxial cable 300 installed therein, and FIG. 16 provides a detail view of the gripping member 290. In addition to the at least one flexible finger 291, the gripping member 290 may have an internal surface 292, a cable passage 293, and a rear shoulder 294. The at least one flexible finger 291 may have a projection 296 extending radially inwardly from the at least one flexible finger 291. As illustrated in FIGS. 15 and 16, a plurality of flexible fingers 291 is shown separated from each other by a space 295 and each having a projection 296. Additionally, each of the plurality of flexible fingers 291 may extend forwardly in the longitudinal opening 222 of the body 204 and be biased radially outwardly so that flexible fingers 291 contact and engage with the internal surface 220 of the body 204.

FIG. 17 illustrates the coaxial cable connector 200" with the coaxial cable 300 fully inserted and with the coaxial cable connector 200" in the closed condition. The coaxial cable 300 extends to the jacket stop 226 of the body 204 in a similar fashion as discussed for the coaxial cable connector 200 with reference to FIG. 11. However, in FIG. 17, a compression tool (not shown) has been used to axially move the gripping member 290 toward the forward end 216 of the body 204. As the gripping member 290 axially moves in the longitudinal opening 222 of the body 204, the angled surface 228 of the body 204 forces the flexible fingers 291 radially inwardly. In this manner, the projections 296 engage the jacket 310 of the coaxial cable 300 to provide the gripping action of the gripping member 290.

Referring now to FIGS. 18-21, there is depicted an exemplary embodiment of a coaxial cable connector 200'". The coaxial cable connector 200'" is similar to the coaxial cable connector 200, except where otherwise noted. Therefore, except as necessary to describe the coaxial cable connector 200'", the discussion of the aspects of the coaxial cable connector 200"" that are similar to the coaxial cable connector 200 will not be restated here with respect to FIGS. 18-21.

Figure 18:
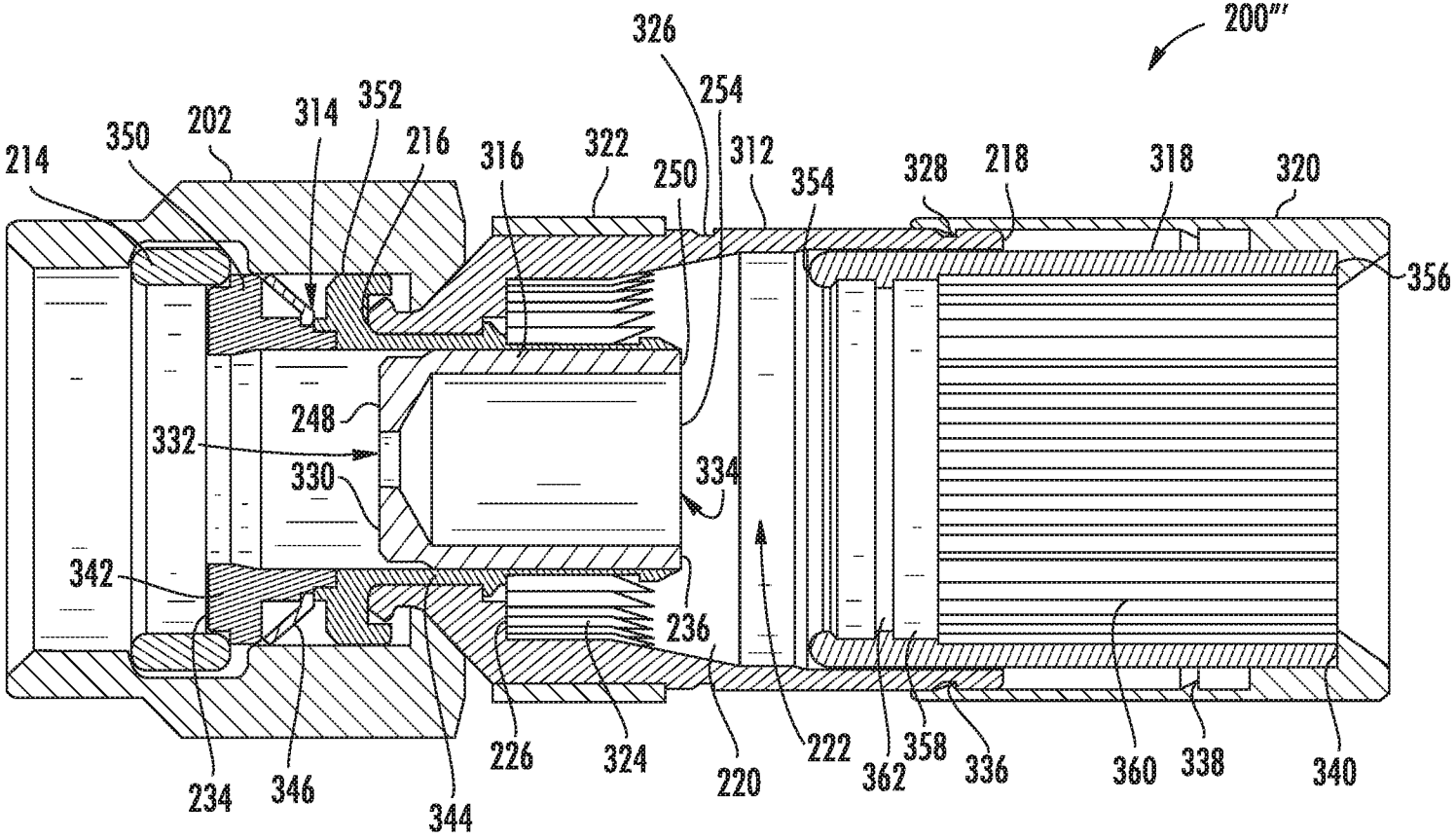
FIG. 18 is a cross-sectional view of another exemplary coaxial cable connector in an assembled state and an open condition without a coaxial cable inserted therein.

FIG. 18 illustrates the coaxial cable connector 200'" in an open condition without a coaxial cable installed therein. As similarly described above, the coaxial cable connector 200'" includes a coupling member 202, a body 312, a post 314, an insulator 316, a gripping member 318, a ring 320, and a gasket 214. The coaxial cable connector 200''' further includes a strengthening collar 322.

The body 312 further includes a plurality of internal ribs 324 at the internal surface 220. The internal ribs 324 extend along an axial length of the body 312 and are circumferentially positioned about the internal surface 220 proximate the jacket stop 226 towards the forward end 216 (between the jacket stop and the rearward end 218). Accordingly, the internal ribs 324 engage the gripping member 318 to prevent rotation therebetween, as explained in more detail below. The body 312 further includes a forward annular notch 326 and a rearward annular notch 328 positioned in an outer surface of the body 312 to engage the ring 320, as explained in more detail below.

The insulator 316 has a forward side 248 and a rearward side 250 and a through-passage 254 in between. Further, the insulator 208 includes a forward wall 330 to define a forward opening 332 of the through-passage 254. A rearward opening 334 of the through-passage 254 is defined at the rearward side 250 of the insulator 316. As shown, the forward opening 332 at the forward side 248 has a smaller diameter than the rearward opening 334 at the rearward side 250, and much of the through-passage 254 therebetween. This creates an air gap between the insulator 316 and the inner conductor 302 of the coaxial cable 300 (see FIG. 7), such that the dielectric formed includes the insulator 316 (e.g., plastic) and air of the airgap. The thickness of the cylindrical wall of the insulator 316 and/or the thickness of the air gap control the impedance (e.g., to match the impedance of the insulator 316 with the inner conductor 302).

The ring 320 includes a forward annular protrusion 336, a rearward annular protrusion 338, and a rearward shelf 340 that inwardly extend from an inner surface of the ring 320. The forward annular protrusion 338 engages the rearward notch 328 of the body 312 in the open condition. Further, the forward annular protrusion 338 and the rearward notch 328 are configured to prevent accidental disengagement of the ring 320 from the body 312. The shelf 340 contacts the rearward end of the gripping member 318, thereby preventing the gripping member 318 from moving past the shelf 340.

A compression tool (not shown) may be used to move the ring 320 and, thereby, axially move the gripping member 318, by engaging the base of the compression tool with the ring 320. The gripping member 318 may be constructed from any suitable material, including a thermoplastic polymer (polyoxymethylene), such as Acetal, as a non-limiting example. The ring 320 may be constructed from any suitable material, including a metallic material, such as brass, as non-limiting example, and may be plated with a conductive corrosion resistant material, such as nickel. Accordingly, the ring 320 provides an interface to engage the compression tool. The walls of the ring 320 engage an outer surface of the body 312 to prevent accidental radial deformation of the body 312, and thereby provides structural support. Further, the ring 320 provides an interface to engage the compression tool (not shown) to prevent any accidental deformation that may result from the rearward end of the gripping member 318 directly engaging the compression tool. In this way, the ring 320 pushes the gripping member 318 to axially move the gripping member 210 toward the forward end 216 of the body 312.

The strengthening collar 322 is positioned around and engages an outer surface of the body 312 towards a forward end 216 of the body 312. The strengthening collar 322 prevents accidental radial deformation of the body 312, particularly when the gripping member 318 axially moves and engages the ribs 324 of the body 312.

Figure 19:
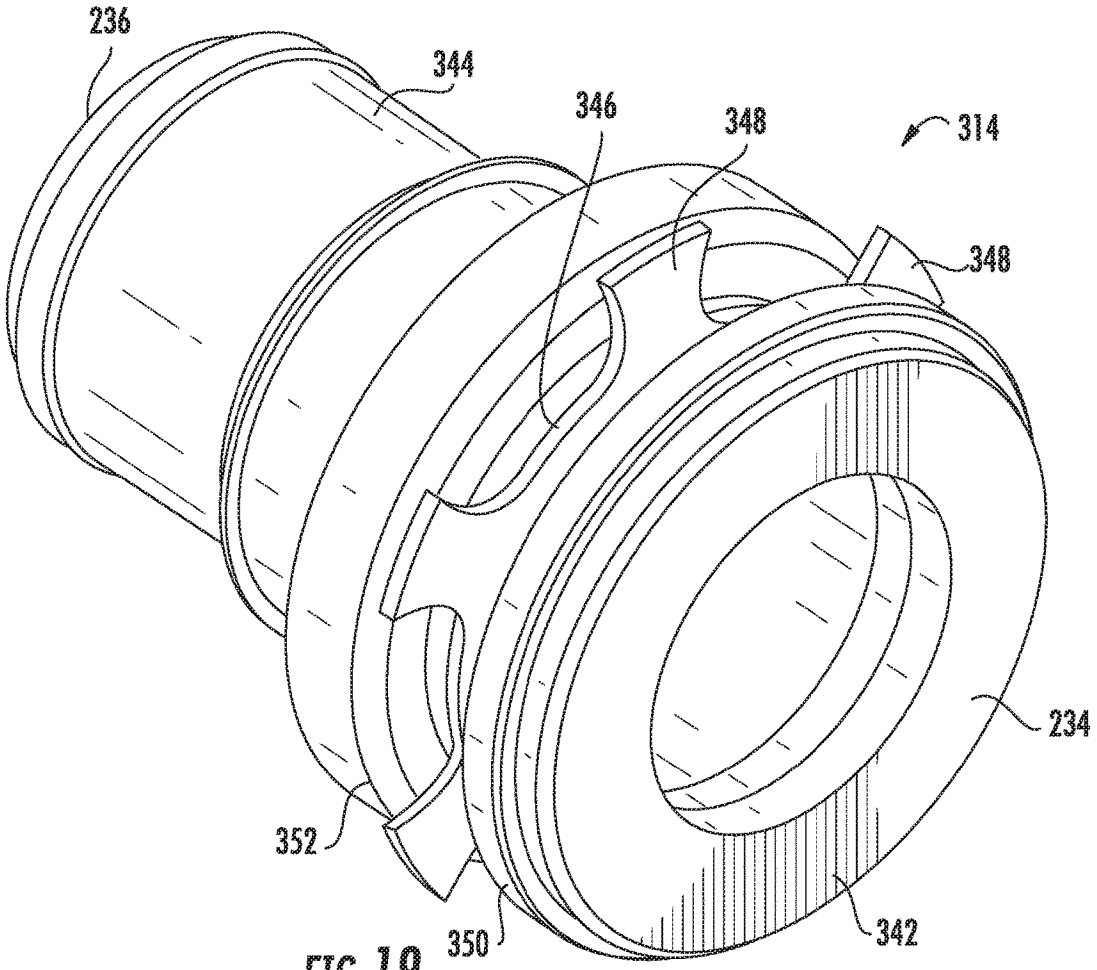
FIG. 19 is a front perspective, detail view of the post of the coaxial cable connector of FIG. 18.

Referring now also to FIG. 19, the post 314 includes a first end 234 and a second end 236. The post 314 includes a forward portion 342, a rearward portion 344, and a disc 346 with a plurality of tabs 348 circumferentially positioned around the disc 346. The three-piece construction allows the post 314 to be stamped instead of molded, which decreases cost and manufacturing time. The forward portion 342 includes an outwardly extending flange 350, and the rearward portion 344 includes an outwardly extending flange 352, with the disc 346 positioned between the outwardly extending flanges 350, 352. An outer diameter of the tabs 348 is greater than an inner diameter of the coupling member 202 (see FIG. 18). When the post 314 is positioned within the coupling member 202, the tabs 348 deflect inwardly and are outwardly biased to maintain an electrical connection between the post and the coupling member 202. Further, when the post 314 is positioned within the coupling member 202, the outwardly extending flanges 350, 352 cooperate with the inner surface of the coupling member 202 to stabilize and maintain axial alignment of the post 314 within and relative to the coupling member 202. In other words, the outwardly extending flanges 350, 352 provide structural stability.

Figure 20:
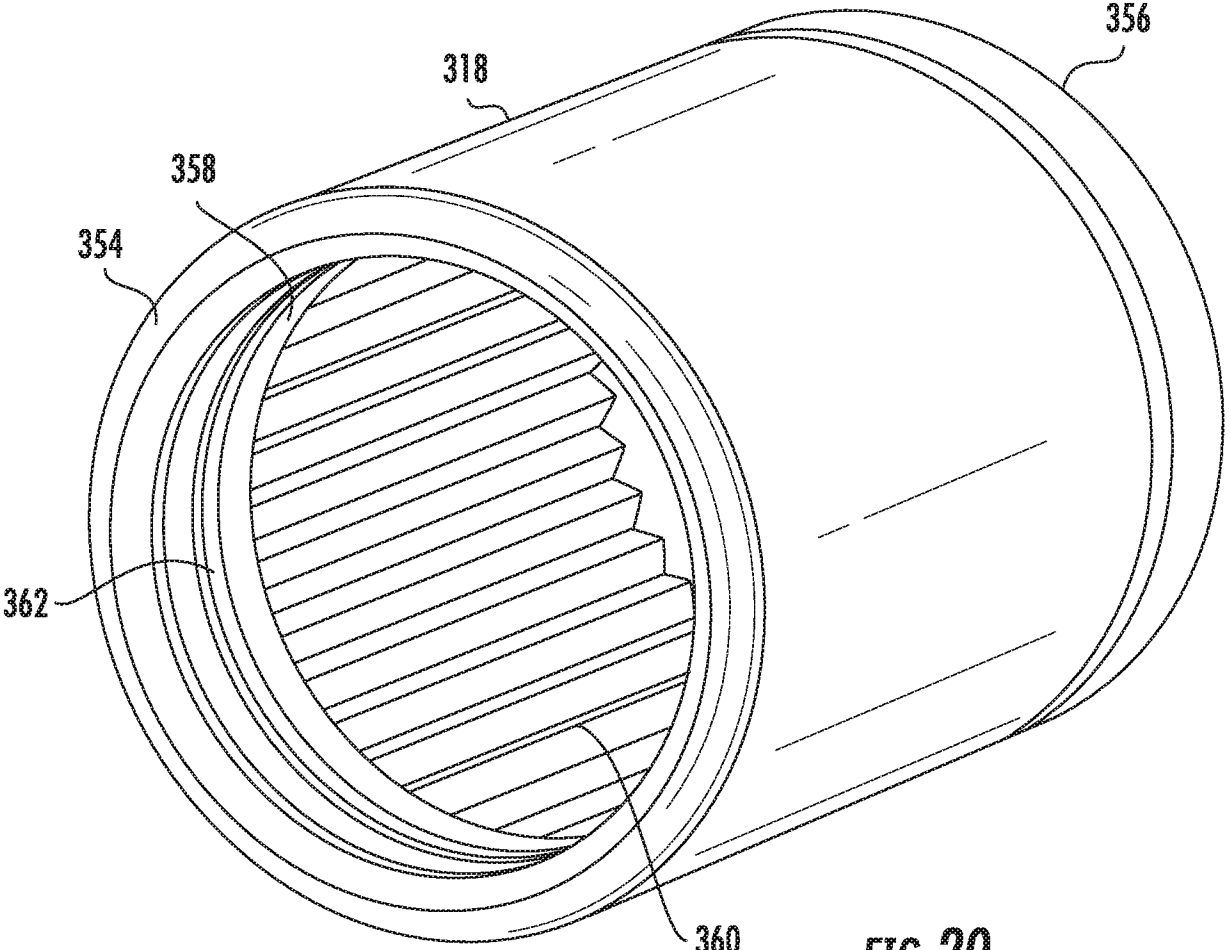
FIG. 20 is a front perspective, detail view of the gripping member of the coaxial cable connector of FIG. 18.

Referring to FIGS. 18 and 20, the gripping member 318 has a forward end 354, a rearward end 356, and an internal surface 358 therebetween. At least a portion of the internal surface 358 may a plurality of internal ribs 360 circumferentially positioned at the internal surface 358 proximate towards the forward rearward end 356 and an annular seal 362 towards the forward end 354. The internal ribs 360 are configured to extend along an axial length of the internal surface 358 of the body gripping member 318. Accordingly, the internal ribs 360 are configured to engage an outer surface of the jacket 310 of the coaxial connector 300 (see FIG. 7) to prevent rotation therebetween, as explained in more detail below. Further, the annular seal 342 is configured to engage the jacket 310 to create a water-tight seal between the gripping member 210 and the jacket 310 and prevent water from leaking into the coaxial cable connector 200'''.

As the gripping member 318 axially moves toward the forward end 216 of the body 312, the internal surface 358 forces the gripping member 318 radially inwardly as the longitudinal opening 222 narrows to provide the gripping action and causes the gripping member 318 to engage the jacket 310 of the coaxial cable 300 received by the body 312.

Figure 21:
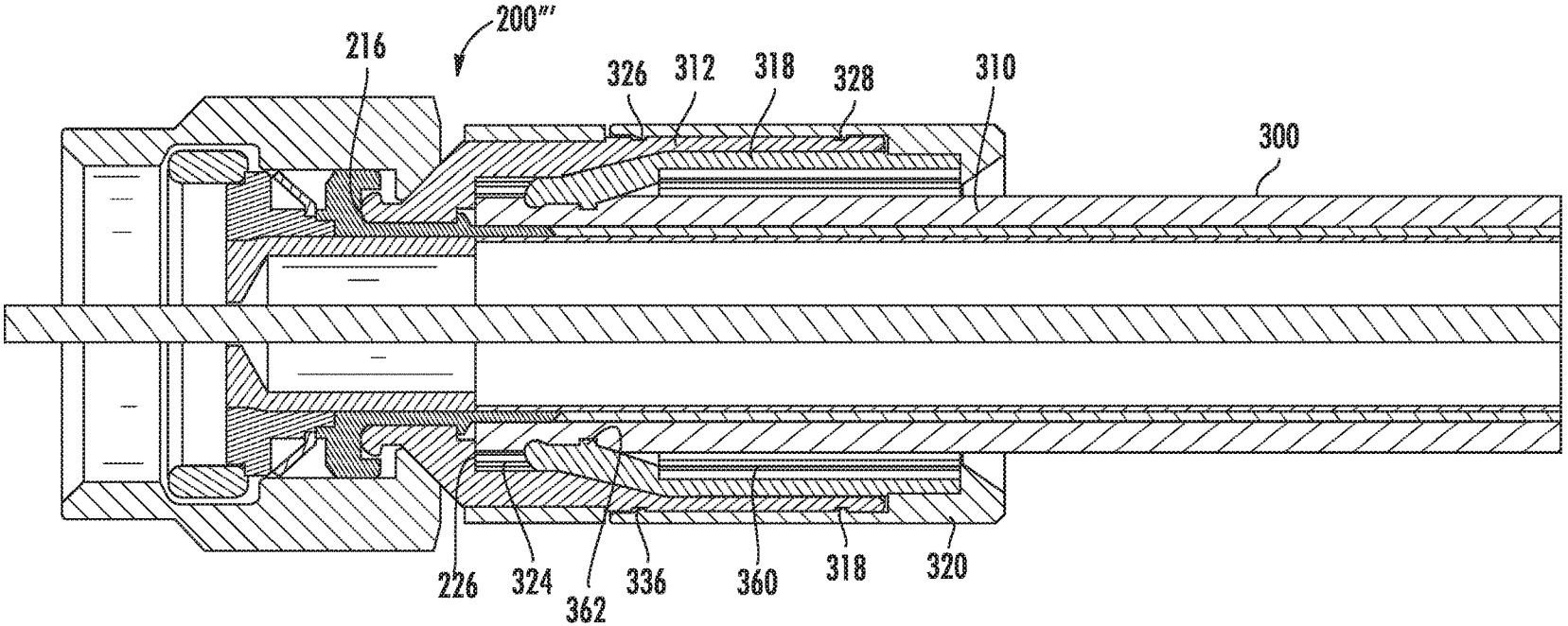
FIG. 21 is a cross-sectional view of the coaxial cable connector of FIG. 18 in a closed condition with the coaxial cable of FIG. 7 inserted therein.

FIG. 21 is a cross-sectional view of the coaxial cable connector of FIG. 18 in a closed condition with the coaxial cable of FIG. 7 inserted therein. In particular, FIG. 21 illustrates the coaxial cable connector 200''' with the coaxial cable 300 fully inserted and with the coaxial cable connector 200''' in the closed condition. The coaxial cable 300 extends to the jacket stop 226 of the body 312 in a similar fashion as discussed for the coaxial cable connector 300 with reference to FIG. 11. However, in FIG. 14, a compression tool (not shown) has been used to axially move the gripping member 318 toward the forward end 216 of the body 312. As the compression tool moves the gripping member 318, the forward annular protrusion 336 of the ring 320 disengages the rearward notch 328 of the body 312. As the gripping member 318 contacts the angled surface 228 of the body 312, the gripping member 318 engages the ribs 324 of the body 312, preventing rotational movement therebetween (while allowing axial movement), and the forward end 354 and annular seal 362 are forced inwardly. The internal ribs 360 of the gripping member 318 engage the jacket 310 and prevent rotational movement therebetween (while allowing axial movement). Finally, the forward protrusion 336 of the ring 320 engages the forward notch 326 of the body 312 and/or the rearward protrusion 338 of the ring 320 engages the rearward notch 328 of the body 312, thereby preventing axial movement of the ring 320 and gripping member 318 relative to the body 312. This also prevents accidental disengagement.

Figure 22:
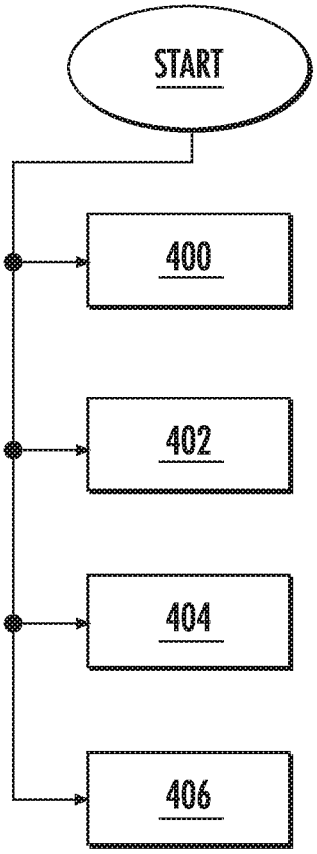
FIG. 22 is a flowchart diagram illustrating an exemplary process for preparing a coaxial cable and connecting the coaxial cable to a coaxial cable connector.

FIG. 22 depicts a method for preparing a coaxial cable 300 and connecting the coaxial cable 300 to a coaxial cable connector 200, 200', 200", 200'". The method may be implemented by connecting a coaxial cable 300 to a coaxial cable connector 200, 200', 200", 200'". The method may be implemented by preparing a coaxial cable 300 by exposing a predetermined length of the inner conductor 302 beyond the ends of the jacket 310, the dielectric 304, and the outer conductor 308, wherein the ends of the jacket 310, the dielectric 304, and the outer conductor 308 remain generally flush with each other (block 400); inserting the prepared coaxial cable 300 into a cable receiving area 224 of a body 204 of a coaxial cable connector 200, 200', 200", 200'", the body 204 having a forward end 216 and a rearward end 218, and an internal surface 220 extending between the forward end 216 and the rearward end 218, the internal surface 220 defining a longitudinal opening 222, and the cable receiving area 224 is proximal the rearward end 218 (block 402); advancing the prepared coaxial cable 300 toward the forward end 216 of the body 204 of the coaxial cable connector 200, 200', 200", 200'" until the end of the jacket 310 contacts a jacket stop 226 proximal the forward end 216 of the body 204, the inner conductor 302 is received by and guided through a through-passage 254 in an insulator 208 movably positioned in a post 206 disposed proximal the forward end 216 of the body 204, and the end of the dielectric 304 contacts a rearward side 250 of the insulator 208, and a forward side 248 of the insulator 208 is flush with a forward face 242 of the post 206 (block 404); and axially moving a gripping member 212, 280, 290 disposed within the longitudinal opening 222 of the body 204 proximal the rearward end 218 of the body 204 toward the forward end 216 of the body 204 to cause a gripping action of the gripping member 212, 280, 290 to engage the jacket 310 of the coaxial cable 300 received by the body 204 to secure the coaxial cable 300 in the body 204 (block 406).

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A coaxial cable connector for attachment to an end of a coaxial cable, the coaxial cable comprising an inner conductor, a dielectric surrounding the inner conductor, an outer conductor surrounding the dielectric, and a jacket surrounding the outer conductor, the coaxial cable connector comprising:

a body having a forward end and a rearward end, wherein an internal surface extends between the forward end and the rearward end, the internal surface defining a longitudinal opening, and wherein the body comprises a cable receiving area proximal the rearward end and a jacket stop proximal the forward end;

a post positioned in the body proximal the forward end of the body, wherein the post comprises a first end and a second end with a bore extending therebetween, and wherein the bore comprises an inner surface and opens toward the rearward end of the body at the second end of the post;

an insulator movably disposed in the bore of the post, wherein the insulator comprises an outer surface in contact with the post, a through-passage, and a movement limiter to limit movement of the insulator in the post;

a gripping member disposed within the longitudinal opening of the body proximal the rearward end of the body, wherein the gripping member comprises an internal surface having a plurality of circumferentially spaced ribs extending radially inwardly and circumferentially around the internal surface, wherein the gripping member is axially movable in the body, and wherein the gripping member provides a gripping action as the gripping member axially moves toward the forward end of the body; and a coupling member attached to the body at the forward end of the body.

2. The coaxial cable connector of claim 1, wherein the jacket stop comprises a rearward facing surface extending radially inwardly from the internal surface of the body.

3. The coaxial cable connector of claim 2, wherein the forward end of the body comprises a neck area, and wherein the rearward facing surface forms a rear surface of the neck area, and wherein the post is positioned in the body by friction fit at the neck area.

4. The coaxial cable connector of claim 1, wherein the movement limiter comprises at least one projection extending radially outwardly from the outer surface of the insulator.

5. The coaxial cable connector of claim 4, wherein the post comprises a groove in the inner surface of the bore, and wherein the at least one projection locates in the groove to limit movement of the insulator.

6. The coaxial cable connector of claim 1, wherein the first end of the post comprises a forward face; and wherein the insulator comprises a forward side and a rearward side, and wherein the movement limiter limits movement of the insulator to where the forward side of the insulator is flush with the forward face of the post.

7. The coaxial cable connector of claim 1, wherein the longitudinal opening comprises a transverse internal dimension, and wherein the transverse internal dimension lessens toward the forward end of the body at a portion of the longitudinal opening along the internal surface.

8. The coaxial cable connector of claim 7, wherein the narrowing transverse internal dimension forces the gripping member radially inwardly to provide the gripping action as the gripping member axially moves toward the forward end of the body.

9. The coaxial cable connector of claim 1, wherein the body comprises a plurality of internal circumferentially spaced ribs.

10. The coaxial cable connector of claim 1, wherein the gripping member comprises an internal surface and at least a portion of the internal surface has projections extending radially inwardly.

11. The coaxial cable connector of claim 1, wherein at least a portion of the internal surface has an annular seal extending radially inwardly.

12. The coaxial cable connector of claim 1, wherein the gripping member comprises at least one flexible finger.

13. The coaxial cable connector of claim 1, further comprising a ring movably disposed within the body proximal to the rearward end of the body; wherein the ring contacts the gripping member and axially moves the gripping member toward the forward end of the body when the ring axially moves toward the forward end of the body.

14. The coaxial cable connector of claim 1, wherein at least a portion of the body is positioned between a ring and the gripping member.

* * * * *